US010228111B2

(12) United States Patent
Demuynck et al.

(10) Patent No.: US 10,228,111 B2
(45) Date of Patent: Mar. 12, 2019

(54) STANDARDIZED TROFFER FIXTURE

(71) Applicant: CREE, INC., Durham, NC (US)

(72) Inventors: Randolph Cary Demuynck, Wake Forest, NC (US); Nicholas W. Medendorp, Jr., Raleigh, NC (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 14/716,480

(22) Filed: May 19, 2015

(65) Prior Publication Data

US 2015/0252982 A1 Sep. 10, 2015

Related U.S. Application Data

(63) Continuation of application No. 13/844,431, filed on Mar. 15, 2013, now Pat. No. 9,052,075.

(51) Int. Cl.
*F21S 8/02* (2006.01)
*F21V 13/04* (2006.01)
(Continued)

(52) U.S. Cl.
CPC ..... *F21V 13/04* (2013.01); *F21S 8/026* (2013.01); *F21S 9/02* (2013.01); *F21S 9/022* (2013.01);
(Continued)

(58) Field of Classification Search
CPC .... F21S 8/02; F21S 8/024; F21S 8/026; F21S 4/008; F21V 15/01; F21V 17/00;
(Continued)

(56) References Cited

U.S. PATENT DOCUMENTS

D853,825 10/1931 Guth ..... D26/24
2,356,654 A 8/1944 Cullman ..... 200/84 C
(Continued)

FOREIGN PATENT DOCUMENTS

CN 1762061 4/2006
CN 1934369 3/2007
(Continued)

OTHER PUBLICATIONS

Notice of Completion of Pretrial Re-examination from Japanese Patent appl. No. 2013-543207, dated Jun. 30, 2015.
(Continued)

*Primary Examiner* — Anh T Mai
*Assistant Examiner* — Steven Y Horikoshi

(57) ABSTRACT

A direct troffer-style fixture for solid state light sources and pan structures for use in these fixtures. The fixture comprises a door frame assembly that is attached to the pan. The pan housing is defined by a base and two angled side walls. End caps are attached to the side walls. End reflectors extend at an angle away from the end caps and attach to the base. The end caps, the end reflectors, and the base define compartments at both ends of the housing in which components can be housed. A light board is attached to the base using alignment holes in the base and cutout portions of the end reflectors. The multifunctional end reflectors retain elements within the compartments, provide added structural stability to the pan, aid in aligning a light board, and they reflect light that impinges on them toward the open end of the fixture.

20 Claims, 6 Drawing Sheets

(51) Int. Cl.

| | |
|---|---|
| ***F21S 9/02*** | (2006.01) |
| ***F21V 7/00*** | (2006.01) |
| ***F21V 15/015*** | (2006.01) |
| ***F21V 23/00*** | (2015.01) |
| *F21V 15/01* | (2006.01) |
| *F21Y 103/10* | (2016.01) |
| *F21Y 115/10* | (2016.01) |

(52) U.S. Cl.
CPC ..... *F21V 7/005* (2013.01); *F21V 15/015* (2013.01); *F21V 23/006* (2013.01); *F21V 15/01* (2013.01); *F21Y 2103/10* (2016.08); *F21Y 2115/10* (2016.08)

(58) Field of Classification Search
CPC .... F21V 23/003; F21V 23/007; F21V 23/009; F21V 23/026; F21V 7/005; F21V 23/006; H01L 33/58
USPC ..... 362/225, 235, 244–247, 311.01, 311.02, 362/362, 364, 365, 374
See application file for complete search history.

(56) References Cited

U.S. PATENT DOCUMENTS

| | | | | |
|---|---|---|---|---|
| 3,381,124 | A | 4/1968 | Eisenberg | 362/354 |
| 3,743,826 | A | 7/1973 | Halfaker | |
| 3,790,774 | A | 2/1974 | Miller | |
| 4,261,030 | A * | 4/1981 | Hernandez | F21V 7/005 362/263 |
| 4,939,627 | A | 7/1990 | Herst et al. | 362/299 |
| 5,025,356 | A | 6/1991 | Gawad | 362/221 |
| 5,526,190 | A | 6/1996 | Hubble, III | 347/102 |
| 5,823,663 | A | 10/1998 | Bell et al. | 362/362 |
| D407,473 | S | 3/1999 | Wimbock | D23/328 |
| 6,079,851 | A | 6/2000 | Altman | |
| 6,102,550 | A | 8/2000 | Edward, Jr. | |
| 6,149,283 | A | 11/2000 | Conway et al. | 362/236 |
| 6,155,699 | A | 12/2000 | Miller et al. | 362/293 |
| 6,210,025 | B1 | 4/2001 | Schmidt et al. | 362/362 |
| 6,234,643 | B1 | 5/2001 | Lichon, Jr. | 362/147 |
| 6,402,347 | B1 | 6/2002 | Maas et al. | 362/294 |
| 6,443,598 | B1 | 9/2002 | Morgan | 362/342 |
| 6,523,974 | B2 | 2/2003 | Engel | 362/224 |
| 6,578,979 | B2 | 6/2003 | Truttmann-Battig | 362/92 |
| 6,598,998 | B2 | 7/2003 | West | 257/E33.073 |
| D496,121 | S | 9/2004 | Santoro | D26/74 |
| 6,871,983 | B2 | 3/2005 | Jacob et al. | 362/364 |
| 6,948,838 | B2 | 9/2005 | Kunstler | 362/237 |
| 6,948,840 | B2 | 9/2005 | Grenda et al. | 362/555 |
| 6,951,415 | B2 | 10/2005 | Amano | 362/297 |
| 7,021,797 | B2 | 4/2006 | Minano et al. | 362/355 |
| 7,049,761 | B2 | 5/2006 | Timmermans et al. | 315/246 |
| 7,063,449 | B2 | 6/2006 | Ward | 345/102 |
| 7,111,969 | B2 | 9/2006 | Bottesch | 362/299 |
| 7,175,296 | B2 | 2/2007 | Cok | 362/147 |
| 7,213,940 | B1 | 5/2007 | Van de Ven et al. | 362/231 |
| 7,217,004 | B2 | 5/2007 | Park | 362/240 |
| 7,237,924 | B2 | 7/2007 | Martineau et al. | 362/231 |
| D556,358 | S | 11/2007 | Santoro | D26/74 |
| 7,338,182 | B1 | 3/2008 | Hastings et al. | 362/150 |
| 7,341,358 | B2 | 3/2008 | Hsieh | 362/97.1 |
| 7,510,299 | B2 | 3/2009 | Timmermans et al. | 362/225 |
| 7,520,636 | B2 | 4/2009 | Van Der Poel | 362/290 |
| D593,246 | S | 5/2009 | Fowler et al. | D26/76 |
| 7,559,672 | B1 | 7/2009 | Parkyn et al. | 362/244 |
| 7,594,736 | B1 | 9/2009 | Kassay et al. | 362/223 |
| D604,446 | S | 11/2009 | Fowler et al. | D26/76 |
| 7,614,767 | B2 | 11/2009 | Zulim | |
| 7,618,157 | B1 | 11/2009 | Galvez et al. | 362/294 |
| 7,618,160 | B2 | 11/2009 | Chinniah et al. | 362/326 |
| D608,932 | S | 1/2010 | Castelli | D26/76 |
| 7,654,688 | B2 | 2/2010 | Li | |
| 7,654,702 | B1 | 2/2010 | Ding et al. | 362/294 |
| 7,661,844 | B2 | 2/2010 | Sekiguchi et al. | 362/249 |
| D611,183 | S | 3/2010 | Duarte | D26/76 |
| 7,674,005 | B2 | 3/2010 | Chung et al. | 362/223 |
| 7,686,470 | B2 | 3/2010 | Chiang | 362/147 |
| 7,686,484 | B2 | 3/2010 | Heiking et al. | 362/375 |
| 7,712,918 | B2 | 5/2010 | Siemiet et al. | 362/241 |
| 7,722,220 | B2 | 5/2010 | Van de Ven | 362/294 |
| 7,722,227 | B2 | 5/2010 | Zhang et al. | 362/364 |
| D617,487 | S | 6/2010 | Fowler et al. | D26/76 |
| 7,768,192 | B2 | 8/2010 | Van de Ven et al. | 313/503 |
| 7,815,338 | B2 | 10/2010 | Siemiet et al. | 362/218 |
| 7,824,056 | B2 | 11/2010 | Madireddi et al. | 362/125 |
| 7,828,468 | B2 | 11/2010 | Mayfield et al. | 362/342 |
| 7,868,484 | B2 | 1/2011 | Groff et al. | 362/375 |
| D633,247 | S | 2/2011 | Kong et al. | D26/88 |
| 7,922,354 | B2 | 4/2011 | Everhart | 362/235 |
| 7,926,982 | B2 | 4/2011 | Liu | 362/294 |
| 7,959,332 | B2 | 6/2011 | Tickner | |
| 7,988,321 | B2 | 8/2011 | Wung et al. | 362/218 |
| 7,988,335 | B2 | 8/2011 | Liu et al. | 362/294 |
| 7,991,257 | B1 | 8/2011 | Coleman | |
| 7,993,034 | B2 | 8/2011 | Wegner | 362/296.05 |
| 7,997,762 | B2 | 8/2011 | Wang et al. | 362/249 |
| 8,038,314 | B2 | 10/2011 | Ladewig | |
| 8,038,321 | B1 | 10/2011 | Franck et al. | 362/249.02 |
| 8,070,326 | B2 | 12/2011 | Lee | 362/307 |
| D653,376 | S | 1/2012 | Kong et al. | D26/76 |
| 8,092,043 | B2 | 1/2012 | Lin et al. | 362/249.02 |
| 8,092,049 | B2 | 1/2012 | Kinnune et al. | 362/294 |
| 8,096,671 | B1 | 1/2012 | Cronk | 362/147 |
| D657,488 | S | 4/2012 | Lown et al. | D26/120 |
| 8,162,504 | B2 | 4/2012 | Zhang et al. | 362/217 |
| 8,186,855 | B2 | 5/2012 | Wassel et al. | 362/373 |
| 8,197,086 | B2 | 6/2012 | Watanabe et al. | 362/218 |
| 8,201,968 | B2 | 6/2012 | Maxik et al. | |
| 8,215,799 | B2 | 7/2012 | Vanden Eynden et al. | 362/294 |
| 8,246,219 | B2 | 8/2012 | Teng | 362/217.02 |
| 8,256,927 | B2 | 9/2012 | Hu | 362/218 |
| 8,287,160 | B2 | 10/2012 | Shen | |
| D670,849 | S | 11/2012 | Lay et al. | D26/74 |
| 8,317,354 | B2 | 11/2012 | Gassner et al. | 362/147 |
| D676,848 | S | 4/2013 | Pickard et al. | D26/74 |
| 8,410,514 | B2 | 4/2013 | Kim | 257/99 |
| D684,291 | S | 6/2013 | Goelz et al. | D26/74 |
| 8,480,252 | B2 | 7/2013 | Bertram et al. | 362/243 |
| 8,506,135 | B1 | 8/2013 | Oster | 362/373 |
| 8,523,383 | B1 | 9/2013 | Grigore | |
| 8,556,452 | B2 | 10/2013 | Simon | 362/217.07 |
| 8,591,058 | B2 | 11/2013 | Concepcion | 362/231 |
| 8,591,071 | B2 | 11/2013 | Hochstein | 362/294 |
| 8,602,601 | B2 | 12/2013 | Khazi | |
| 8,616,723 | B2 | 12/2013 | Zhang | 362/218 |
| D698,975 | S | 2/2014 | Blessitt et al. | D26/74 |
| 8,641,243 | B1 | 2/2014 | Rashidi | 362/373 |
| D701,988 | S | 4/2014 | Clements | D26/74 |
| 8,696,154 | B2 | 4/2014 | Hutchens | 362/217.05 |
| 8,702,264 | B1 * | 4/2014 | Rashidi | F21S 8/026 362/147 |
| 8,764,244 | B2 | 7/2014 | Jeon | 362/218 |
| D714,988 | S | 10/2014 | Park et al. | D26/74 |
| D721,198 | S | 1/2015 | Glasbrenner | D26/76 |
| 9,010,956 | B1 | 4/2015 | Davis | |
| 9,052,075 | B2 | 6/2015 | Demuynck et al. | |
| 2003/0063476 | A1 | 4/2003 | English et al. | |
| 2004/0001344 | A1 | 1/2004 | Hect | |
| 2004/0085779 | A1 | 5/2004 | Pond et al. | 362/516 |
| 2004/0100796 | A1 | 5/2004 | Ward | |
| 2004/0240230 | A1 | 12/2004 | Kitajima | 362/558 |
| 2005/0180135 | A1 | 8/2005 | Mayer | 362/240 |
| 2005/0264716 | A1 | 12/2005 | Kim et al. | |
| 2005/0281023 | A1 | 12/2005 | Gould | |
| 2006/0221611 | A1 * | 10/2006 | Noh | G02F 1/133603 362/247 |
| 2006/0245208 | A1 * | 11/2006 | Sakamoto | G02F 1/133603 362/612 |
| 2006/0262521 | A1 | 11/2006 | Piepgras et al. | 362/149 |
| 2006/0279671 | A1 * | 12/2006 | Han | G02F 1/133603 349/61 |

(56) References Cited

U.S. PATENT DOCUMENTS

| | | | | |
|---|---|---|---|---|
| 2006/0291206 | A1 | 12/2006 | Angelini et al. | 362/244 |
| 2007/0070625 | A1* | 3/2007 | Bang | G02F 1/133603 362/240 |
| 2007/0109779 | A1 | 5/2007 | Sekiguchi et al. | |
| 2007/0115670 | A1 | 5/2007 | Roberts et al. | |
| 2007/0115671 | A1 | 5/2007 | Roberts et al. | |
| 2007/0211457 | A1 | 9/2007 | Mayfield et al. | 362/223 |
| 2007/0253205 | A1 | 11/2007 | Welker | 362/373 |
| 2007/0279910 | A1 | 12/2007 | Lin | |
| 2007/0297181 | A1 | 12/2007 | Mayfield et al. | 362/342 |
| 2008/0019147 | A1 | 1/2008 | Erchak | 362/607 |
| 2008/0037284 | A1 | 2/2008 | Rudisill | 362/629 |
| 2008/0049422 | A1 | 2/2008 | Trenchard et al. | 362/238 |
| 2008/0232093 | A1 | 9/2008 | Kim | 362/147 |
| 2008/0278943 | A1 | 11/2008 | Van Der Poel | 362/240 |
| 2008/0303977 | A1* | 12/2008 | Sekiguchi | G02F 1/133606 349/64 |
| 2009/0034247 | A1* | 2/2009 | Boyer | F21S 8/033 362/225 |
| 2009/0073693 | A1 | 3/2009 | Nall | 362/249.02 |
| 2009/0161356 | A1 | 6/2009 | Negley et al. | 362/231 |
| 2009/0168439 | A1* | 7/2009 | Chiang | F21S 8/04 362/404 |
| 2009/0196024 | A1 | 8/2009 | Heiking et al. | 362/150 |
| 2009/0225543 | A1 | 9/2009 | Jacobson et al. | |
| 2009/0237958 | A1 | 9/2009 | Kim | |
| 2009/0262543 | A1 | 10/2009 | Ho | 362/373 |
| 2009/0296388 | A1 | 12/2009 | Wu et al. | 362/235 |
| 2009/0310354 | A1 | 12/2009 | Zampini et al. | 362/235 |
| 2009/0323334 | A1 | 12/2009 | Roberts et al. | |
| 2010/0039579 | A1* | 2/2010 | Park | G02F 1/133603 349/58 |
| 2010/0061108 | A1 | 3/2010 | Zhang et al. | 362/364 |
| 2010/0097794 | A1 | 4/2010 | Teng et al. | 362/231 |
| 2010/0103678 | A1 | 4/2010 | Van de Ven et al. | 362/294 |
| 2010/0110679 | A1 | 5/2010 | Teng et al. | |
| 2010/0142202 | A1 | 6/2010 | Sugishita | |
| 2010/0172133 | A1 | 7/2010 | Lie | 362/235 |
| 2010/0177514 | A1* | 7/2010 | Liu | F21S 8/04 362/235 |
| 2010/0177532 | A1 | 7/2010 | Simon et al. | |
| 2010/0188609 | A1 | 7/2010 | Matsuki et al. | |
| 2010/0253591 | A1 | 10/2010 | Hwu et al. | 345/1.3 |
| 2010/0254128 | A1 | 10/2010 | Pickard et al. | 362/231 |
| 2010/0254145 | A1 | 10/2010 | Yamaguchi | |
| 2010/0254146 | A1 | 10/2010 | McCanless | |
| 2010/0270903 | A1 | 10/2010 | Jao et al. | 313/46 |
| 2010/0271843 | A1 | 10/2010 | Holten et al. | 362/609 |
| 2010/0277905 | A1 | 11/2010 | Janik et al. | 362/235 |
| 2010/0277934 | A1* | 11/2010 | Oquendo, Jr. | F21S 8/02 362/433 |
| 2010/0295468 | A1 | 11/2010 | Pedersen et al. | 315/294 |
| 2010/0302778 | A1 | 12/2010 | Dabiet | |
| 2010/0327768 | A1 | 12/2010 | Kong et al. | 315/294 |
| 2011/0032714 | A1 | 2/2011 | Chang | 362/373 |
| 2011/0043132 | A1 | 2/2011 | Kim et al. | |
| 2011/0090671 | A1 | 4/2011 | Bertram et al. | 362/84 |
| 2011/0141722 | A1 | 6/2011 | Acampora et al. | 362/218 |
| 2011/0141734 | A1 | 6/2011 | Li | 362/235 |
| 2011/0156584 | A1 | 6/2011 | Kim | 315/32 |
| 2011/0164417 | A1 | 7/2011 | Huang | 362/235 |
| 2011/0175533 | A1 | 7/2011 | Homan | 315/130 |
| 2011/0199005 | A1 | 8/2011 | Bretschneider et al. | |
| 2011/0199769 | A1 | 8/2011 | Bretschneider et al. | |
| 2011/0222291 | A1 | 9/2011 | Peng | |
| 2011/0246146 | A1 | 10/2011 | Kauffman et al. | 703/2 |
| 2011/0255292 | A1 | 10/2011 | Shen | 362/311 |
| 2011/0267810 | A1 | 11/2011 | Higman et al. | 362/218 |
| 2011/0267823 | A1 | 11/2011 | Angelini et al. | 362/277 |
| 2011/0286225 | A1 | 11/2011 | Konishi | |
| 2011/0305024 | A1 | 12/2011 | Chang | 362/294 |
| 2012/0033420 | A1 | 2/2012 | Kim et al. | 362/235 |
| 2012/0038289 | A1 | 2/2012 | Jee et al. | 315/291 |
| 2012/0051041 | A1 | 3/2012 | Edmond et al. | 362/231 |
| 2012/0120658 | A1 | 5/2012 | Wilk | |
| 2012/0134146 | A1 | 5/2012 | Smith | 362/225 |
| 2012/0140442 | A1 | 6/2012 | Woo | 362/95 |
| 2012/0140461 | A1 | 6/2012 | Huang et al. | |
| 2012/0206926 | A9 | 8/2012 | Chou | |
| 2012/0320576 | A1 | 12/2012 | Wald | |
| 2013/0235568 | A1 | 9/2013 | Green et al. | 362/218 |
| 2013/0242550 | A1 | 9/2013 | Suen | |
| 2013/0258652 | A1 | 10/2013 | Hsieh | 362/225 |
| 2014/0265930 | A1 | 9/2014 | Harris | 315/307 |
| 2015/0016100 | A1 | 1/2015 | Ishii | 362/223 |

FOREIGN PATENT DOCUMENTS

| | | | |
|---|---|---|---|
| CN | 1963289 | A | 5/2007 |
| CN | 101660715 | | 3/2010 |
| CN | 101776254 | | 7/2010 |
| CN | 101776254 | A | 7/2010 |
| CN | 101790660 | | 7/2010 |
| CN | 101790660 | A | 7/2010 |
| CN | 102072443 | | 5/2011 |
| DE | 102007030186 | | 1/2009 |
| DE | 102007030186 | A1 | 1/2009 |
| DE | 202010001832 | | 7/2010 |
| EP | 1298383 | | 4/2003 |
| EP | 1298383 | A2 | 4/2003 |
| EP | 1298383 | A2 | 4/2003 |
| EP | 1357335 | A2 | 10/2003 |
| EP | 1653254 | | 3/2006 |
| EP | 1737051 | | 12/2006 |
| EP | 1847762 | | 10/2007 |
| EP | 1847762 | A2 | 10/2007 |
| EP | 1847762 | A2 | 10/2007 |
| EP | 1860467 | | 11/2007 |
| EP | 2287520 | A2 | 2/2011 |
| EP | 2290690 | A2 | 3/2011 |
| EP | 2636945 | A2 | 9/2013 |
| GB | 774198 | | 5/1957 |
| JP | 1069809 | | 3/1998 |
| JP | 2002244027 | | 11/2002 |
| JP | U3097327 | | 8/2003 |
| JP | 2004140327 | | 5/2004 |
| JP | 2004345615 | | 12/2004 |
| JP | 2004345615 | A | 12/2004 |
| JP | 2006173624 | | 6/2006 |
| JP | 2008147044 | | 6/2008 |
| JP | 3151501 | U | 6/2009 |
| JP | 2009295577 | | 12/2009 |
| JP | 2010103687 | | 5/2010 |
| JP | 2011018571 | | 8/2011 |
| JP | 2011018572 | | 8/2011 |
| TW | 200524186 | | 7/2005 |
| TW | 200524186 | A | 7/2005 |
| TW | 200914759 | A | 4/2009 |
| TW | 201018826 | | 5/2010 |
| TW | 201018826 | A | 5/2010 |
| WO | WO03102467 | | 12/2003 |
| WO | WO2009030233 | | 3/2009 |
| WO | WO2009140761 | A1 | 11/2009 |
| WO | WO2009157999 | | 12/2009 |
| WO | WO2009157999 | A | 12/2009 |
| WO | WO2009157999 | A1 | 12/2009 |
| WO | WO2010024583 | | 3/2010 |
| WO | WO2010024583 | A2 | 3/2010 |
| WO | WO2010042216 | | 4/2010 |
| WO | WO2010042216 | A2 | 4/2010 |
| WO | WO2011074424 | A1 | 6/2011 |
| WO | WO2011096098 | A1 | 8/2011 |
| WO | WO2011098191 | | 8/2011 |
| WO | WO2011118991 | A2 | 9/2011 |
| WO | WO2011140353 | A2 | 11/2011 |
| WO | WO03102467 | | 12/2013 |

OTHER PUBLICATIONS

Pretrial Report from Japanese Appl. No. 2013-543207, dated Jun. 19, 2015.

(56) References Cited

OTHER PUBLICATIONS

Decision of Rejection from Chinese Patent Appl. No. 201180052998.4, dated Jul. 16, 2015.
Office Action from U.S. Appl. No. 12/873,303, dated Jun. 22, 2015.
Response to OA from U.S. Appl. No. 12/873,303, filed Aug. 21, 2015.
Office Action from U.S. Appl. No. 13/341,741, dated Jun. 22, 2015.
Office Action from U.S. Appl. No. 13/443,630, dated Jun. 23, 2015.
Response to OA from U.S. Appl. No. 13/443,630, filed Aug. 21, 2015.
Office Action from U.S. Appl. No. 13/189,535, dated Jul. 14, 2015.
Office Action from U.S. Appl. No. 13/453,924, dated Jul. 21, 2015.
Office Action from U.S. Appl. No. 13/442,746, dated Jul. 27, 2015.
Office Action from U.S. Appl. No. 14/020,757, dated Aug. 3, 2015.
First Office Action from Chinese Patent Appl. No. 2012800369142. dated Mar. 26, 2015.
Office Action from U.S. Appl. No. 13/464,745, dated Apr. 2, 2015.
Office Action from U.S. Appl. No. 13/442,746, dated Apr. 28, 2015.
Office Action from U.S. Appl. No. 13/368,217, dated May 13, 2015.
Office Action from U.S. Appl. No. 13/828,348, dated May 27, 2015.
Office Action from U.S. Appl. No. 13/787,727, dated Jan. 29, 2015.
Office Action from U.S. Appl. No. 13/429,080, dated Feb. 18, 2015.
Office Action from U.S. Appl. No. 13/453,924, dated Mar. 10, 2015.
First Official Action from European Patent Appl. No. 12 743 003.1-1757, dated Jan. 16, 2015.
Second Office Action and Search Report from Chinese Appl. No. 2011800529984, dated Dec. 26, 2014.
International Report and Written Opinion from PCT/US2013/049225, dated Jan. 22, 2015.
Office Action from U.S. Appl. No. 13/626,346, dated Nov. 20, 2014.
Office Action from U.S. Appl. No. 12/873,303, dated Nov. 28, 2014.
Office Action from U.S. Appl. No. 13/464,745, dated Dec. 10, 2014.
Office Action from U.S. Appl. No. 13/341.741, dated Dec. 24, 2014.
Office Action from U.S. Appl. No. 13/189,535, dated Jan. 13, 2015.
Office Action from U.S. Appl. No. 13/442,746. dated Sep. 15, 2014.
Office Action from U.S. Appl. No. 13/429,080. dated Sep. 16, 2014.
Office Action from U.S. Appl. No. 13/443,630, dated Oct. 10, 2014.
Office Action from U.S. Appl. No. 13/368,217, dated Oct. 22, 2014.
Office Action from U.S. Appl. No. 12/961,385, dated Nov. 6, 2014.
Office Action from U.S. Appl. No. 13/453,924. dated Nov. 27, 2014.
Decision of Rejection from Japanese Appl. No. 2013-543207, dated Nov. 25, 2014.
Office Action from Mexican Appl. No. 100881, dated Nov. 28, 2014.
Preliminary Report on Patentability from PCT/US2013/035668, dated Oct. 14, 2014.
Communication from European Patent Appl. No. 13701525.1-1757, dated Sep. 26, 2014.
Office Action from U.S. Appl. No. 13/464,745, dated Jul. 16, 2014.
International Preliminary Report on Patentability and Written Opinion from PCT/US2013/021053, dated Aug. 21, 2014.
International Preliminary Report on Patentabiliby from PCT/US2012/071800 dated Jul. 10, 2014.
Office Action from U.S. Appl. No. 13/189,535, dated Jun. 20, 2014.
Office Action from U.S. Appl. No. 13/453,924, dated Jun. 25, 2014.
Office Action from U.S. Appl. No. 13/443,630, dated Jul. 1, 2014.
First Office Action from Chinese Patent Appl. No. 2011800529984, dated May 4, 2014.
Office Action from U.S. Appl. No. 13/544,662, dated May 5, 2014.
Office Action from U.S. Appl. No. 13/341,741, dated Jun. 6, 2014.
Office Action from U.S. Appl. No. 13/464,745, dated Feb. 12, 2014.
Office Action from U.S. Appl. No. 13/453,924, dated Feb. 19, 2014.
Office Action from U.S. Appl. No. 13/341,741, dated Jan. 14, 2014.
Office Action from U.S. Appl. No. 13/370,252, dated Dec. 20, 2013.
International Search Report and Written Opinion from PCT/US2013/049225, dated Oct. 24, 2013.
Office Action from U.S. Appl. No. 12/961,385, dated Apr. 26, 2013.
Response to OA from U.S. Appl. No. 12/961,385, filed Jul. 24, 2013.
Office Action from U.S. Appl. No. 13/464,745, dated Jul. 16, 2013.
Office Action from U.S. Appl. No. 12/961,385, dated Nov. 6, 2013.
Office Action from U.S. Appl. No. 29/387,171. dated May 2, 2012.
Response to OA from U.S. Appl. No. 29/387,171, filed Aug. 2, 2012.
Office Action from U.S. Appl. No. 29/368,970, dated Jun. 19, 2012.
Office Action from U.S. Appl. No. 29/368,970, dated Aug. 24, 2012.
Response to OA from U.S. Appl. No. 29/368,970, filed Nov. 26, 2012.
Final Rejection issued in Korean Design Appl. No. 30-2011-0038114, dated Jun. 14, 2013.
Final Rejection issued in Korean Design Appl. No. 30-2011-0038115, dated Jun. 14, 2013.
Final Rejection issued in Korean Design Appl. No. 30-2011-0038116, dated Jun. 17, 2013.
International Search Report and Written Opinion from PCT Patent Appl. No. PCT/US2013/035668, dated Jul. 12, 2013.
International Search Report and Written Opinion from PCT Application No. PCT/US2013/021053, dated Apr. 17, 2013.
Notice to Submit a Response from Korean Patent Application No. 30-2011-0038115, dated Dec. 12, 2012.
Notice to Submit a Response from Korean Patent Application No. 30-2011-0038116, dated Dec. 12, 2012.
International Search Report and Written Opinion for PCT Application No. PCT/US2011/062396, dated Jul. 13, 2012.
Office Action from Japanese Design Patent Application No. 2011-18570.
Reason for Rejection from Japanese Design Patent Application No. 2011-18571.
Reason for Rejection from Japanese Design Patent Application No. 2011-18572.
Search Report and Written Opinion from PCT Patent Appl. No. PCT/US2012/047084, dated Feb. 27, 2013.
Search Report and Written Opinion from PCT Patent Appl. No. PCT/US2012/071800, dated Mar. 25, 2013.
U.S. Appl. No. 13/649,052, filed Oct. 10, 2012, Lowes, et al.
U.S. Appl. No. 13/649,067, filed Oct. 10, 2012, Lowes, et al.
U.S. Appl. No. 13/207,204, filed Aug. 10, 2011, Athalye, et al.
U.S. Appl. No. 13/365,844.
U.S. Appl. No. 13/662,618, filed Oct. 29, 2012, Athalye, et al.
U.S. Appl. No. 13/462,388, filed May 2, 2012.
U.S. Appl. No. 13/842,150, filed Mar. 15, 2013, Dixon, et al.
U.S. Appl. No. 13/770,389, filed Feb. 19, 2013, Lowes, et al.
U.S. Appl. No. 13/782,820, filed Mar. 1, 2013, Dixon, et al.
XLamp® C family from Cree®, Inc., Product Family Data Sheet, 15 pages.
XLamp® M family from Cree®, Inc., Product Family Data Sheet, 14 pages.
XLamp® X family from Cree®. Inc., Product Family Data Sheet, 17 pages.
Energy Star® Program Requirements for Solid State Lighting Luminaires, Eligibility Criteria-Version 1.1, final: Dec. 19, 2008.
Assist Recommends . . . . LED Life for General Lighting: Definition of Life, vol. 1, Issue 1, Feb. 2005.
U.S. Appl. No. 12/418,796, filed Apr. 6, 2009, Pickard, et al.
U.S. Appl. No. 12/429,080, filed Mar. 23, 2012, Torres, et al.
U.S. Appl. No. 13/028,946, filed Feb. 16, 2011, Le, et al.
U.S. Appl. No. 13/306,589, filed Nov. 29, 2011, Tarsa, et al.
U.S. Appl. No. 12/873,303, filed Mar. 31, 2010, Edmond, et al.
U.S. Appl. No. 12/961,385, filed Dec. 6, 2010, Pickard, et al.
Cree's XLamp XP-E LED's, data sheet, pp. 1-16.
Cree's XLamp XP-G LED's, data sheet, pp. 1-12.
Office Action from U.S. Appl. No. 12/961,385, dated Nov. 27, 2015.
Office Action from U.S. Appl. No. 13/828,348, dated Nov, 4, 2015.
Office Action from U.S. Appl. No. 14/020,757, dated Nov. 24, 2014.
First Office Action from Chinese Patent Appl. No. 2011800588770, dated Sep. 25, 2015.
Reasons for Rejection from Japanese Patent Appl. No. 2013-543207, dated May 20, 2014.
Grant Notice from European Appl. No. 13701525.1, dated Nov. 19, 2014.
International Search Report and Written Opinion for Patent Application No. PCT/US2011/001517, dated Feb. 27, 2012.

(56) References Cited

OTHER PUBLICATIONS

"IES Approved Method for Measuring Lumen Maintenance of LED light Sources", Sep. 22, 2008, ISBN No. 978-0-87995-227-3, (LM-80).
Office Action from U.S. Appl. No. 13/429,080, dated Sep. 1, 2015.
Office Action from U.S. Appl. No. 14/170,627, dated Oct. 5, 2015.
Office Action from U.S. Appl. No. 13/368,217, dated Oct. 8, 2015.
Office Action from U.S. Appl. No. 13/464,745, dated Oct. 8, 2015.
Office Action from U.S. Appl. No. 29/466,391, dated Oct. 14, 2015.
Examination Report from Taiwanese Patent Appl. No. 100131021, dated Jan. 5, 2016.
Examination from European Patent Appl. No. 12743003.1-1757, dated Jan. 8, 2016.
Notice of Reasons for Rejection from Japanese Patent Appl. No. 2013-543207, dated Feb. 2, 2016.
Examination from European Patent Appl. No. 13 701 525.1-1757, dated Feb. 3, 2016.
Office Action from U.S. Appl. No. 13/189,535; dated Jan. 6, 2016.
Office Action from U.S. Appl. No. 13/341,741; dated Jan. 8, 2016.
Office Action from U.S. Appl. No. 13/873,303; dated Feb. 2, 2016.
Office Action from U.S. Appl. No. 13/464,745; dated Mar. 1, 2016.
Office Action from U.S. Appl. No. 13/368,217; dated Mar. 4, 2016.
Office Action from U.S. Appl. No. 13/189,535; dated Mar. 18, 2016.
Office Action from U.S. Appl. No. 14/020,757; dated Apr. 7, 2016.
Office Action from U.S. Appl. No. 29/466,391; dated May 10, 2016.
Second Office Action for Application No. 2011800588770; dated Mar. 29, 2016.
Office Action for U.S. Appl. No. 13/828,348; dated Jun. 2, 2016.
Notice of Reason for Rejection for Japanese Appl. No. 2013-543207; dated May 24, 2016.
Office Action for Chinese Patent Application No. 2011800588770; dated Sep. 26, 2016.
Notification of Reexamination for Chinese Application No. 2011800529984; dated Oct. 10, 2016.
Office Action for U.S. Appl. No. 13/828,348; dated Oct. 17, 2016.
Office Action for European Application No. 11754767.9; dated Oct. 31, 2016.
Office Action for U.S. Appl. No. 12/873,303; dated Nov. 25, 2016.
Notice of Allowance for Taiwan Application No. 100131021; dated Nov. 28, 2016.
Office Action for U.S. Appl. No. 13/368,217; dated Jan. 3, 2017.
Office Action for U.S. Appl. No. 14/020,757; dated Jul. 19, 2016.
Examination Report from Taiwan Application No. 100131021; dated Jul. 21, 2016.
Office Action for U.S. Appl. No. 14/716,480; dated Aug. 26, 2016.
European Summons for Oral Proceedings for Application No. 12743003.1; dated Sep. 2, 2016.
Office Action for U.S. Appl. No. 13/464,745; dated Sep. 7, 2016.
Office Action for U.S. Appl. No. 14/225,327; dated Oct. 2, 2017.
Office Action for U.S. Appl. No. 13/189,535; dated Oct. 30, 2017.
Office Action for U.S. Appl. No. 14/721,806; dated Nov. 1, 2017.
Office Action for U.S. Appl. No. 14/170,627; dated Nov. 29, 2017.
Office Action for U.S. Appl. No. 14/170,627; dated Jun. 16, 2017.
Office Action for U.S. Appl. No. 12/873,303; dated Aug. 9, 2017.
Office Action for U.S. Appl. No. 13/828,348; dated Sep. 1, 2017.
Foreign Office Action for Japanese Application No. 2013-543207; dated Feb. 14, 2017.
Office Action for U.S. Appl. No. 14/225,327; dated Mar. 14, 2017.
European Notice of Allowance for Application No. 12743003.1; dated Mar. 17, 2017.
Office Action for U.S. Appl. No. 13/189,535; dated Mar. 23, 2017.
Office Action for U.S. Appl. No. 13/464,745; dated Mar. 23, 2017.
Foreign Office Action for Chinese Application No. 2011800529984; dated Apr. 5, 2017.
Office Action for U.S. Appl. No. 14/721,806; dated Apr. 21, 2017.
Office Action for U.S. Appl. No. 13/443,630; dated May 18, 2017.
Office Action for U.S. Appl. No. 13/464,745; dated Dec. 11, 2017.
Office Action for U.S. Appl. No. 13/189,535; dated Apr. 5, 2018.
Office Action for U.S. Appl. No. 14/225,327; dated Apr. 19, 2018.
Office Action for U.S. Appl. No. 13/464,745; dated May 2, 2018.
Foreign Office Action for European Application No. 11754767.9; dated May 7, 2018.
Office Action for U.S. Appl. No. 14/170,627; dated Jun. 4, 2018.
Office Action for U.S. Appl. No. 12/873,303; dated Jun. 19, 2018.
Office Action for U.S. Appl. No. 13/828,348; dated Jun. 26, 2018.
Office Action for U.S. Appl. No. 14/721,806; dated Jul. 27, 2018.

* cited by examiner

FIG. 9a
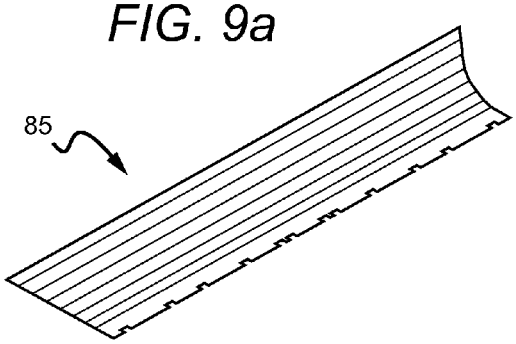
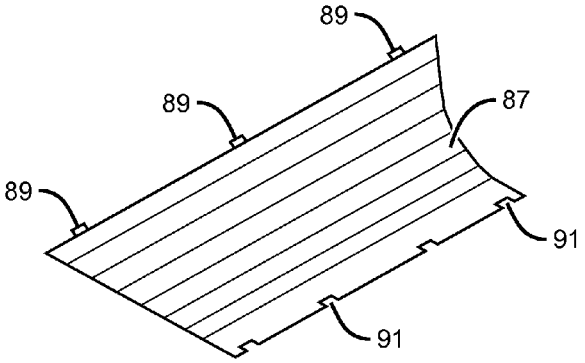
FIG. 9b
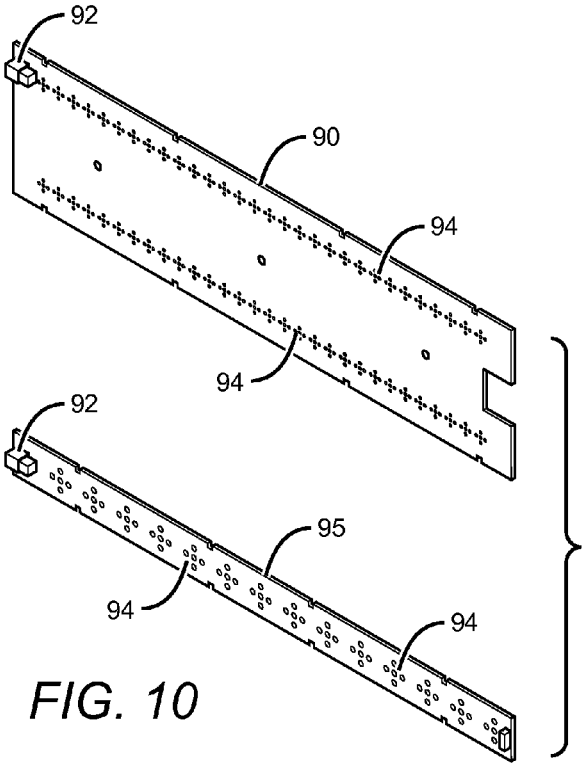
FIG. 10

STANDARDIZED TROFFER FIXTURE

This application is a continuation of and claims the benefit of U.S. patent application Ser. No. 13/844,431, filed on Mar. 15, 2013.

BACKGROUND OF THE INVENTION

Field of the Invention

The invention relates to lighting troffers and, more particularly, to indirect, direct, and direct/indirect lighting troffers that are well-suited for use with solid state lighting sources, such as light emitting diodes (LEDs).

Description of the Related Art

Troffer-style fixtures are ubiquitous in commercial office and industrial spaces throughout the world. In many instances these troffers house elongated fluorescent light bulbs that span the length of the troffer. Troffers may be mounted to or suspended from ceilings. Often the troffer may be recessed into the ceiling, with the back side of the troffer protruding into the plenum area above the ceiling. Typically, elements of the troffer on the back side dissipate heat generated by the light source into the plenum where air can be circulated to facilitate the cooling mechanism. U.S. Pat. No. 5,823,663 to Bell, et al. and U.S. Pat. No. 6,210,025 to Schmidt, et al. are examples of typical troffer-style fixtures. Another example of a troffer-style fixture is U.S. patent application Ser. No. 12/961,385 to Pickard, which is commonly assigned with the present application and incorporated by reference herein.

More recently, with the advent of efficient solid state lighting sources, these troffers have been used with LEDs, for example. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. Incandescent lights are very energy-inefficient light sources with approximately ninety percent of the electricity they consume being released as heat rather than light. Fluorescent light bulbs are more energy efficient than incandescent light bulbs by a factor of about 10, but are still relatively inefficient. LEDs by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1000 hours. Fluorescent bulbs can also have lifetimes longer than incandescent bulbs such as in the range of approximately 10,000-20,000 hours, but provide less desirable color reproduction. In comparison, LEDs can have lifetimes between 50,000 and 70,000 hours. The increased efficiency and extended lifetime of LEDs is attractive to many lighting suppliers and has resulted in LED lights being used in place of conventional lighting in many different applications. It is predicted that further improvements will result in their general acceptance in more and more lighting applications. An increase in the adoption of LEDs in place of incandescent or fluorescent lighting would result in increased lighting efficiency and significant energy saving.

Other LED components or lamps have been developed that comprise an array of multiple LED packages mounted to a (PCB), substrate, or submount. The array of LED packages can comprise groups of LED packages emitting different colors, and specular reflector systems to reflect light emitted by the LED chips. Some of these LED components are arranged to produce a white light combination of the light emitted by the different LED chips.

In order to generate a desired output color, it is sometimes necessary to mix colors of light which are more easily produced using common semiconductor systems. Of particular interest is the generation of white light for use in everyday lighting applications. Conventional LEDs cannot generate white light from their active layers; it must be produced from a combination of other colors. For example, blue emitting LEDs have been used to generate white light by surrounding the blue LED with a yellow phosphor, polymer or dye, with a typical phosphor being cerium-doped yttrium aluminum garnet (Ce:YAG). The surrounding phosphor material "downconverts" some of the blue light, changing it to yellow light. Some of the blue light passes through the phosphor without being changed while a substantial portion of the light is downconverted to yellow. The LED emits both blue and yellow light, which combine to yield white light.

In another known approach, light from a violet or ultraviolet emitting LED has been converted to white light by surrounding the LED with multicolor phosphors or dyes. Indeed, many other color combinations have been used to generate white light.

Because of the physical arrangement of the various source elements, multicolor sources often cast shadows with color separation and provide an output with poor color uniformity. For example, a source featuring blue and yellow sources may appear to have a blue tint when viewed head on and a yellow tint when viewed from the side. Thus, one challenge associated with multicolor light sources is good spatial color mixing over the entire range of viewing angles. One known approach to the problem of color mixing is to use a diffuser to scatter light from the various sources.

Another known method to improve color mixing is to reflect or bounce the light off of several surfaces before it is emitted from the lamp. This has the effect of disassociating the emitted light from its initial emission angle. Uniformity typically improves with an increasing number of bounces, but each bounce has an associated optical loss. Some applications use intermediate diffusion mechanisms (e.g., formed diffusers and textured lenses) to mix the various colors of light. Many of these devices are lossy and, thus, improve the color uniformity at the expense of the optical efficiency of the device.

Many current luminaire designs utilize forward-facing LED components with a specular reflector disposed behind the LEDs. One design challenge associated with multi-source luminaires is blending the light from LED sources within the luminaire so that the individual sources are not visible to an observer. Heavily diffusive elements are also used to mix the color spectra from the various sources to achieve a uniform output color profile. To blend the sources and aid in color mixing, heavily diffusive exit windows have been used. However, transmission through such heavily diffusive materials causes significant optical loss.

Some recent designs have incorporated an indirect lighting scheme in which the LEDs or other sources are aimed in a direction other than the intended emission direction. This may be done to encourage the light to interact with internal elements, such as diffusers, for example. Examples of indirect fixtures can be found in U.S. Pat. No. 7,722,220 to Van de Ven and U.S. patent application Ser. No. 12/873,303 to Edmond et al., both of which are commonly assigned with the present application and incorporated by reference herein.

Modern lighting applications often demand high power LEDs for increased brightness. High power LEDs can draw large currents, generating significant amounts of heat that must be managed. Many systems utilize heat sinks which must be in good thermal contact with the heat-generating light sources. Troffer-style fixtures generally dissipate heat from the back side of the fixture that extends into the plenum. This can present challenges as plenum space decreases in modern structures. Furthermore, the temperature in the plenum area is often several degrees warmer than the room environment below the ceiling, making it more difficult for the heat to escape into the plenum ambient.

SUMMARY OF THE INVENTION

An embodiment of a pan structure for light fixtures comprises the following elements: a housing comprising a horizontal base and two angled sidewalls, said base comprising a plurality of light board alignment holes; first and second vertical end caps removably attached to first and second ends of said housing between said sidewalls, wherein said housing and said end caps define an interior space having an open end opposite said base; and first and second end reflectors in said interior space extending at an angle away from said first and second end caps and removably attaching to said base, wherein said end reflectors, said end caps, and said base define a first and second compartments at said ends of said housing, said end reflectors providing structural support to said pan.

An embodiment of a light fixture comprises a door frame assembly and a pan structure. The door frame assembly comprises: a frame around the perimeter of said door frame assembly; first and second rails spanning said frame from end to end; two side lenses between said rails and said frame; and a center lens between said rails. The pan structure comprises: a housing comprising a horizontal base and two angled sidewalls, said base comprising a plurality of light board alignment holes arranged to align a light board with said first and second rails; and first and second vertical end caps removably attached to first and second ends of said housing between said sidewalls.

BRIEF DESCRIPTION OF THE DRAWINGS

FIGS. 9*a* and 9*b* are perspective views of one half of two different sizes of back reflectors that may be used the embodiments of the present invention.

FIG. 10 shows perspective views of two light boards that may be used in embodiments of the present invention.

DETAILED DESCRIPTION OF THE INVENTION

Figure 1:
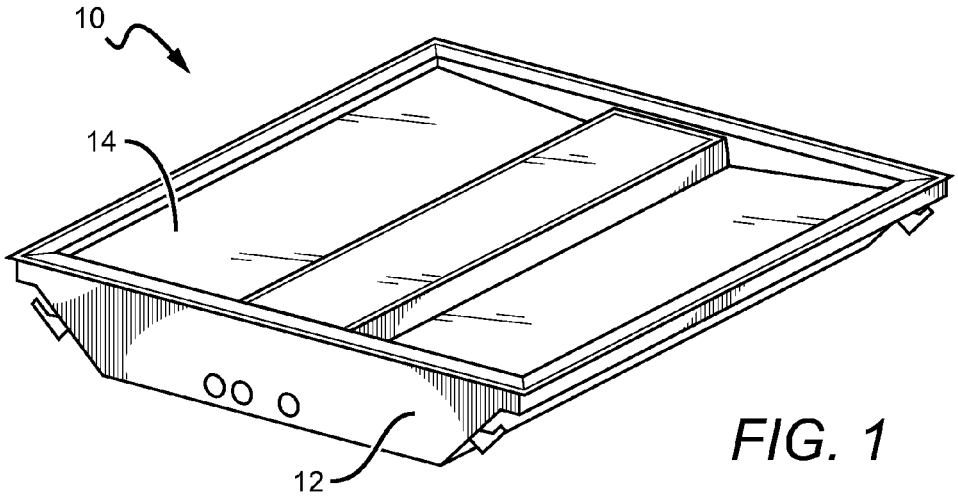
FIG. 1 is a perspective view of a lighting fixture according to an embodiment of the present invention.

Embodiments of the present invention provide a direct troffer-style fixture that is particularly well-suited for use with solid state light sources such as LEDs and pan structures for use in these fixtures. The fixture comprises a door frame assembly that is removably attached to the pan structure. The pan structure housing is defined by a base and two angled side walls. First and second end caps are attached to the side walls defining an interior space. First and second end reflectors extend at an angle away from the end caps and attach to the base. The end caps, the end reflectors, and the base define first and second compartments at both ends of the housing in which components can be housed. A light board is removably attached to the base using alignment holes in the base and cutout portions of the end reflectors. A back reflector covers most of the interior surfaces of the pan to direct more light out of the fixture. The multifunctional end reflectors retain elements within the compartments, provide added structural stability to the pan, aid in aligning a light board, and they reflect light that impinges on them toward the open end of the fixture.

It is understood that when an element is referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one element to another. It is understood that these terms are intended to encompass different orientations of the device in addition to the orientation depicted in the figures.

Although the ordinal terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention.

As used herein, the term "source" can be used to indicate a single light emitter or more than one light emitter functioning as a single source. For example, the term may be used to describe a single blue LED, or it may be used to describe a red LED and a green LED in proximity emitting as a single source. Thus, the term "source" should not be construed as a limitation indicating either a single-element or a multi-element configuration unless clearly stated otherwise.

The term "color" as used herein with reference to light is meant to describe light having a characteristic average wavelength; it is not meant to limit the light to a single wavelength. Thus, light of a particular color (e.g., green, red, blue, yellow, etc.) includes a range of wavelengths that are grouped around a particular average wavelength.

Embodiments of the invention are described herein with reference to cross-sectional view illustrations that are schematic illustrations. As such, the actual size of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of any elements of a device and are not intended to limit the scope of the invention.

FIG. 1 is a perspective view of a lighting fixture 10 according to an embodiment of the present invention. The fixture 10 includes a pan structure 12 and a door frame assembly 14 that are detachably joined using a hook-and-eye structure, for example, such that the door frame assembly 14 can be attached at one side of the pan 12 and then swung shut and latched/screwed on the other side. It is also possible to attach the pan 12 and the door frame assembly 14 with screws, adhesives, or the like. It is understood that many different door frame assemblies can be used with the pan structure 12.

Figure 2:
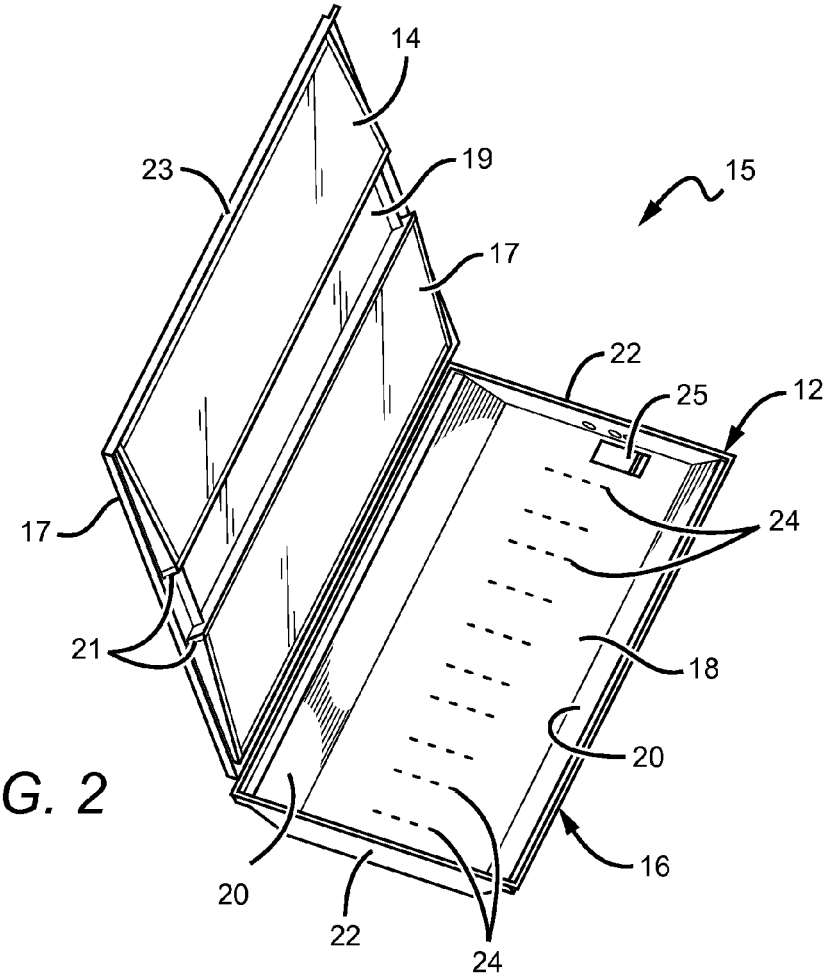
FIG. 2 is a perspective view of a fixture according to an embodiment of the present invention.

FIG. 2 is a perspective view of a fixture 15 with the door frame assembly 14 swung open to reveal the interior of the pan 10. In this view, the pan 10 has been stripped on any internal elements. A housing comprises a horizontal base 18 and two angled side walls 20. Two end caps 22 are attached to the base 18 and the side walls 20 to define an interior space with an open end. Several alignment holes 24 are shown along the length of the base 18. As discussed in more detail herein, the alignment holes 24 provide a mounting mechanism for light boards that ensure that the light boards and light sources thereon are self-aligned with elements of the door frame assembly 14 to provide the desired optical output.

In this embodiment, the door frame assembly comprises two side lenses 17, a center lens 19, and two rails 21 that span from one end of a perimeter frame 23 to the other end. Here, the lenses 17 are less diffusive than the center lens 19. The rails 21 and the frame provide structure to the assembly 14. The rails 21 also additionally function to provide mechanical shielding from some of the light sources housed in the pan 12 that reduces imaging of the sources. This allows for the fixture to function as a direct fixture where the light from the light sources is emitted directly toward the emission surface rather than being initially bounced off of a reflective surface. In another embodiment, the door frame assembly can comprise a perimeter frame surrounding a single acrylic diffuser. It is understood that many different door frame assemblies may be used to achieve a particular output light profile.

The pan 12 can be made from many materials such as plastic or metal, with one suitable material being aluminum (Al). The pan 12 can also be provided in many sizes, including standard troffer fixture sizes, such as the fixture 15 which measures 2 ft by 4 ft (2×4) or the fixture 10 which measures 2 ft by 2 ft (2×2), for example. The 4×2 and 2×2 embodiments are discussed throughout this disclosure using common reference numerals for like elements. However, it is understood that these elements have different dimensions that correspond to one of the fixture sizes. Furthermore, it is understood that embodiments of the pan can be customized to fit most any desired fixture dimensions. A ceiling-side access panel 25 provides access to components of the fixture, a backup batter for example, that are mounted on the base 18 in the area around the panel 25. A back reflector 26 comprises two side reflectors 26*a* and 26*b* that are removably attached to the base 18 and, in some embodiments, to the side walls 20.

Figure 3:
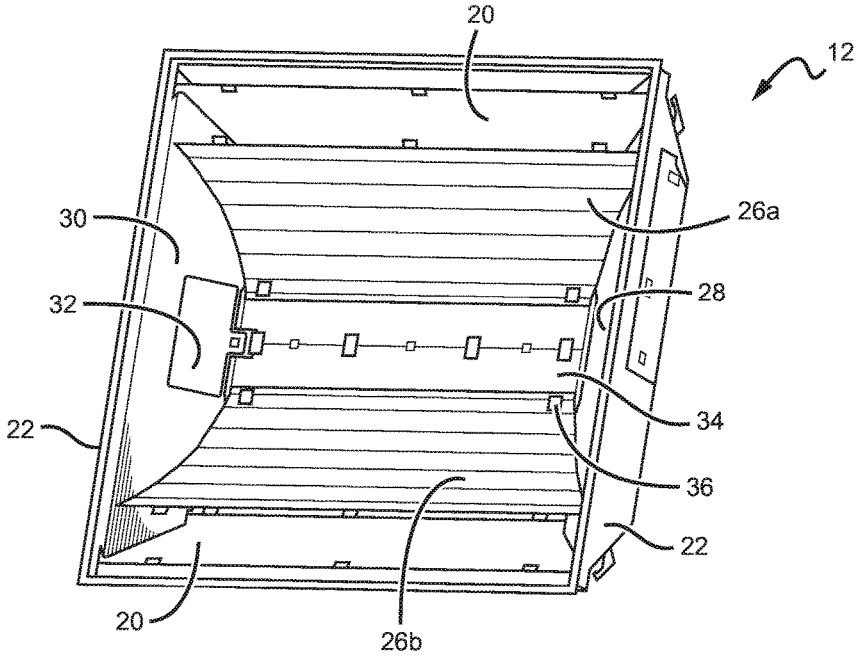
FIG. 3 is a perspective view of a pan structure according to an embodiment of the present invention.

FIG. 3 is a perspective view of a pan structure 10 according to an embodiment of the present invention. First and second end reflectors 28, 30 are disposed the ends of the housing, adjacent to the end caps 22. In this embodiment, the reflectors 28, 30 angle away from the end caps 22 at approximately a 45° angle, providing additional structural stability to the pan 12. The reflectors 28, 30 may be disposed at many other angles as well. The end reflectors 28, 30 should comprise a reflective surface on the side that faces the interior space of the pan 12. A room-side removable panel 32 is on the second end reflector 30 as shown. The end reflectors 28, 30 are discussed in detail herein. At least one light board 34 is removably attached to the base 18 through alignment holes (not shown). The light board 34 aligns with the center portion of the end reflectors 28, 30 as well. In this embodiment, the end reflectors 28, 30 comprise a central cutout portion 27 where they attach to the base. The cutout portion 27 may be used to align the light board 34 by placing the ends of the light board 34 within the cutout portions 27 before attaching it to the base 18. Thus, the end reflectors 28, 30 also function as an alignment element for placement of the light board 34 and the light sources. Alignment of the light sources in the pan 12 is significant in this embodiment, as the sources are designed to align with the rails 21 of the door frame assembly 14. As mentioned, the rails 21 mechanically shield the sources from producing unpleasant imaging in the output profile. Holes in the side reflectors 26*a*, 26*b* match up with the alignment holes on the light board 34 and the alignment holes 24 on the base 18. Thus, the reflectors 26*a*, 26*b* and the light boards 34 can be mounted with a single mechanism, such as retention clips 36, such that the light boards 34 and the reflectors 26*a*, 26*b* are properly aligned within the pan 12.

Figure 5:
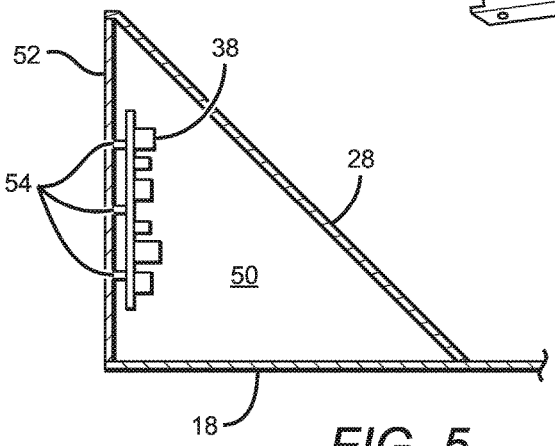
FIG. 5 is a cross-sectional representation of the first compartment that may be used in embodiments of the present invention.
Figure 4:
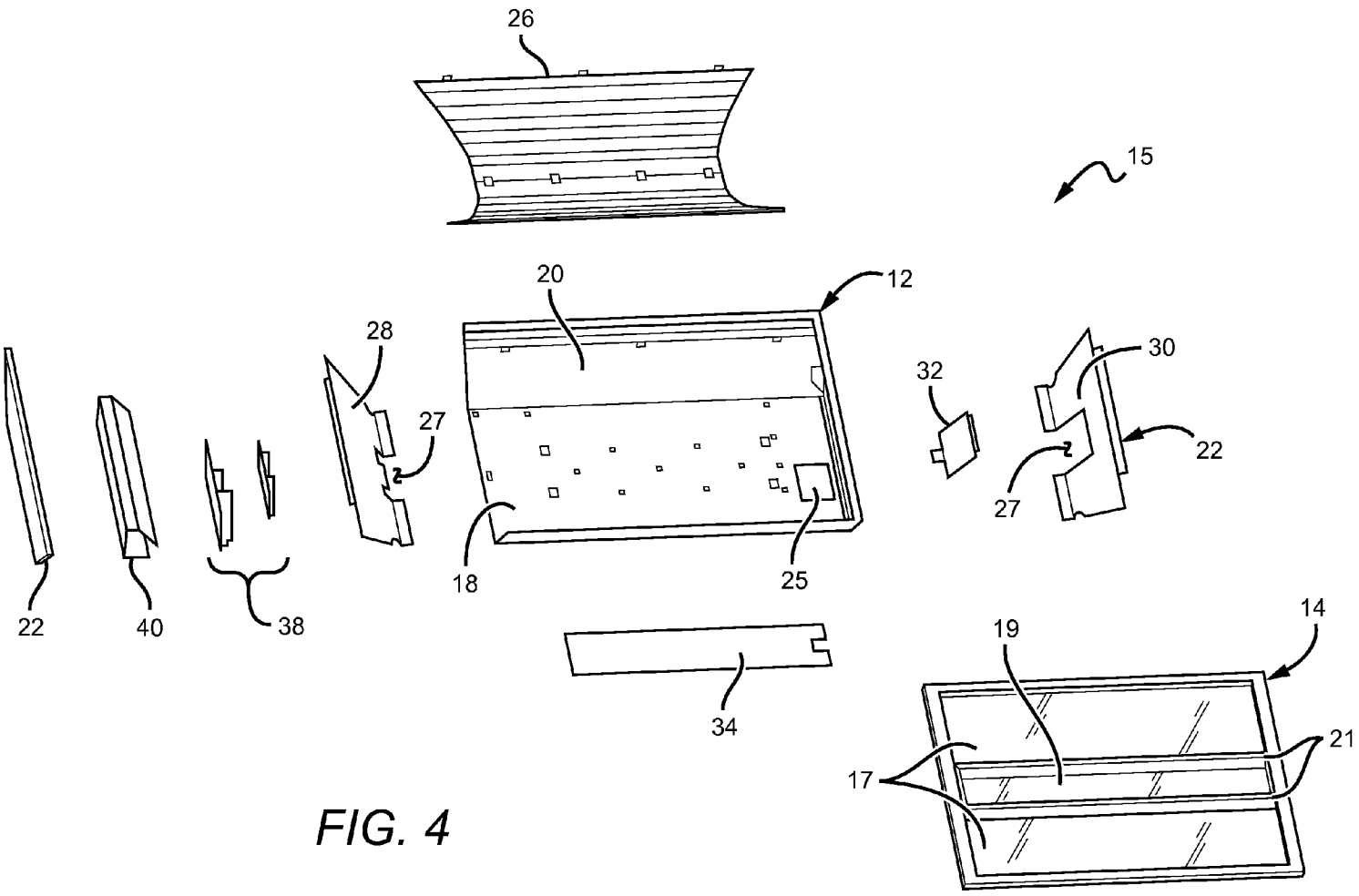
FIG. 4 is an exploded view of the fixture according to an embodiment of the present invention.

FIG. 4 is an exploded view of the fixture 15. When assembled, the base 18, the end caps 22, and the first and second end reflectors 28, 30 define first and second compartments (as shown in FIG. 5). These compartments provide space to house various components, such as circuits, batteries, wiring, and the like. In this particular embodiment, a driver circuit 38 is housed with the first compartment. Electronic components within the compartments may be shielded and isolated from the end caps 22 and the end reflectors 28, 30. Here, an isolation structure 40 partially surrounds the driver circuit 38 for this purpose. The isolation structure may also function as a flame barrier (e.g., Formex™, ceramic, or a UL94 5VA rated transparent plastic) which is required to cover the high voltage components if they are used.

Various driver circuits may be used to power the light sources. Suitable circuits are compact enough to fit within the compartments while still providing the power delivery and control capabilities necessary to drive high-voltage LEDs, for example. At the most basic level a driver circuit may comprise an AC to DC converter, a DC to DC converter, or both. In one embodiment, the driver circuit comprises an AC to DC converter and a DC to DC converter both of which are located inside the compartment. In another embodiment, the AC to DC conversion is done remotely (i.e., outside the fixture), and the DC to DC conversion is done at the control circuit inside the compartment. In yet another embodiment, only AC to DC conversion is done at the control circuit within the compartment.

FIG. 5 is a cross-sectional representation of the first compartment 50 which is formed by the base 18, the end cap 52, and the first end reflector 28. The second compartment on the other end is similarly shaped. Thus, when assembled, the end reflectors 28, 30 function as a retention element. In this particular embodiment, the driver circuit 38 is mounted to a first end cap 52 that has built-in standoffs 54 to separate the circuit 38 from the end cap 52. The first end cap 52 also has tuning holes (not shown in this view) for accessing the portions of the circuit 38 from the exterior of the pan 12.

Figure 6A:
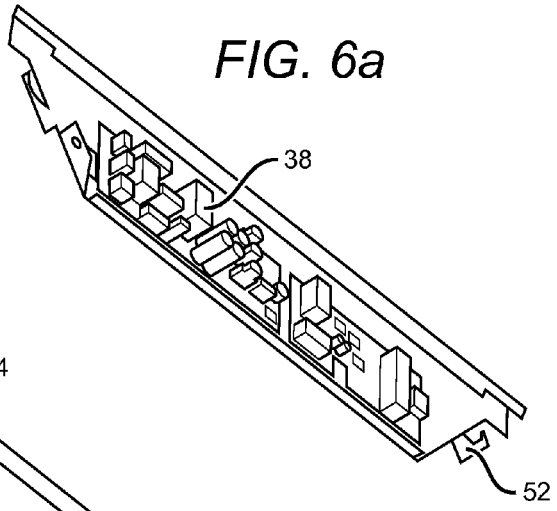
FIGS. 6*a* and 6*b* show detailed view of the first end cap that may be used in embodiments of the present invention.
Figure 6B:
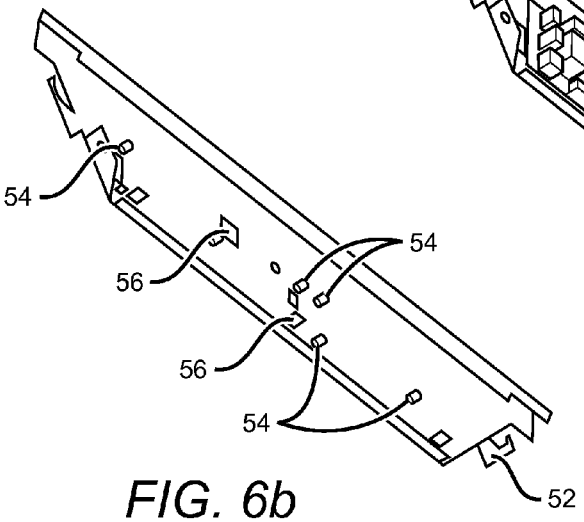

FIGS. 6*a* and 6*b* shows a detailed view of the first end cap 52 that may be used in embodiments of the present invention. FIG. 6*a* shows the end cap 52 with the driver circuit 38 mounted thereto. When mounted, the driver circuit 38 would be housed within the first compartment 50. FIG. 6*b* shows the end cap 52 with the driver circuit removed to expose the standoffs 54 and the tuning holes 56. The tuning holes 56 provide access to the driver circuit 38 after it has already been installed and connected to the light sources inside the pan 12. This allows for testing of the connected circuitry after assembly. For example, a test boot can be hooked up to the driver circuit 38 using Pogo pins to test the operability of various electrical components.

Figure 7:
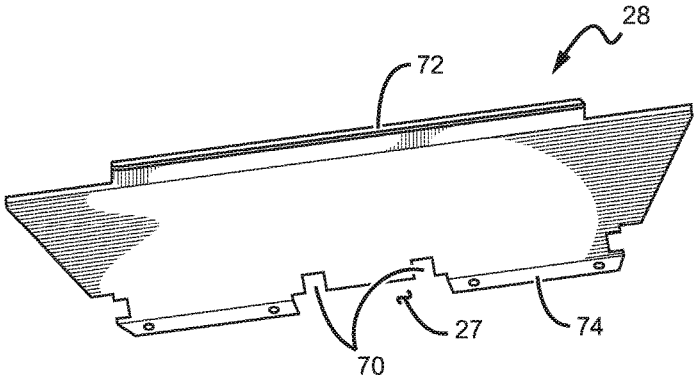
FIG. 7 is a detailed perspective view of the first end reflector that may be used in embodiments of the present invention.

FIG. 7 is a detailed perspective view of the first end reflector 28 that may be used in embodiments of the present invention. The end reflector 28 is shaped to define a notch 70 that allows access between the first compartment 50 and areas of the interior space of the pan to allow for the passage of wiring between the two spaces, for example, from the driver circuit 38 to the light sources on the interior. The top portion 72 of the end reflector 28 attaches to the upper part of the end cap 52 and the bottom portion attaches to the base 18 to form the first compartment 50. As previously discussed, the cutout portions 27 aid in alignment of the light board 34.

Figure 8:
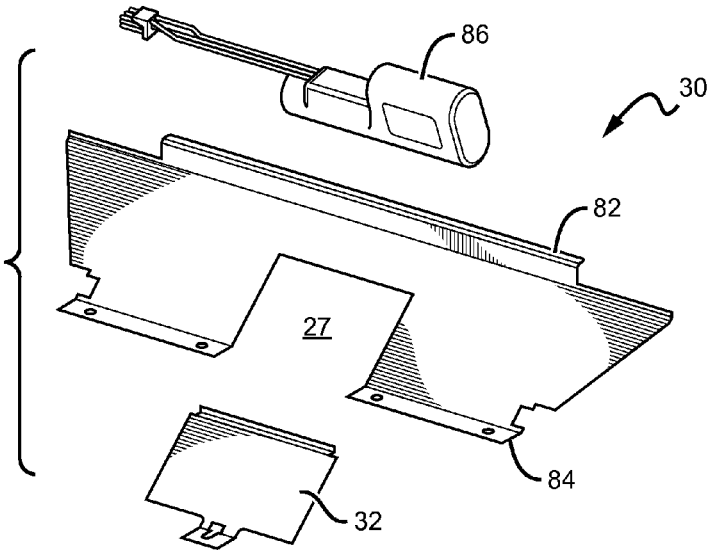
FIG. 8 is a detailed perspective view of the second end reflector that may be used in embodiments of the present invention.

FIG. 8 is a detailed perspective view of the second end reflector 30 that may be used in embodiments of the present invention. The second end reflector 30 may be mounted to the end cap 22 similarly, using top and bottom portions 82, 84. The second end reflector 30 comprises the removable access panel 32 which allows for room-side testing, maintenance, and/or replacement of the components housed within the second compartment. In this embodiment a battery 86 is housed therein, providing for emergency lighting if there is a power interruption to the fixture. Thus, the battery 86 may be accessed from the room-side of the pan 12 by simply removing the access panel 32. After repairs/replacement, the panel 32 may be replaced, and the battery 86 is again securely protected in the second chamber. As shown in FIGS. 2 and 4, a ceiling-side access panel 25 also provides access to the battery 86 in this embodiment. Thus, maintenance can be done from the room-side or the ceiling-side without having to remove the fixture from its mount or significantly disassemble any portion of the pan 12.

When assembled in the pan 12, the end reflectors 28, 30 perform several functions: they retain elements within the compartments; they provide added structural stability to the pan 12; they aid in aligning the light board 34; and they reflect light that impinges on them toward the open end of the fixture.

FIGS. 9*a* and 9*b* are perspective views of one half of two different sizes of back reflectors 85, 87 that may be used in the embodiments of the present invention. With reference to FIG. 4, in the embodiment of fixture 15, the back reflector 26 comprises two pieces, side reflectors 26*a*, 26*b*, that join in the middle to form a single reflective body. In other embodiments, the back reflector can be one monolithic structure. FIG. 8*a* shows one half of a two-piece back reflector 85 for use in a 2×4 fixture. FIG. 8*b* shows part of a back reflector for use in a 2×2 fixture. The side reflectors 85, 87 are shaped to substantially cover the base 18 and the side walls 20 within the interior space to redirect any light up toward the open end. The side reflectors 85, 87 may be attached using a combination of retention clips 36 and screws, for example. In these embodiments, the side reflectors 85, 87 are faceted to create the bended shape; however a back reflector with a smooth bending transition may be used. Many different back reflector shapes are possible.

The back reflector 87 may be mounted in the pan 12 using tabs 89 to attach to the side walls 20 and notches that can be fastened to the base 18 with screws underneath the light board 34.

The back reflectors 85, 87 may comprise many different materials. For many indoor lighting applications, it is desirable to present a uniform, soft light source without unpleasant glare, color striping, or hot spots. Thus, the back reflectors 85, 87 may comprise a diffuse white reflector such as a microcellular polyethylene terephthalate (MCPET) material or a DuPont/WhiteOptics material, for example. Other white diffuse reflective materials can also be used. The back reflectors 85, 87 may also be aluminum with a diffuse white coating.

FIG. 10 shows perspective views of two light boards 90, 95 that may be used in embodiments of the present invention. The light board 90 is designed for use in a 2×2 fixture. The light board 95 is sized for a 2×4 fixture. It is understood that nearly any length of light board can be built by combining light boards together to yield the desired length. A connector 92 provides an electrical connection to the boards 90, 95. The light sources 94 can be mounted in a linear pattern or in clusters as shown in FIG. 9. In some embodiments, the light sources may be mounted to a light strip and then to the light board.

Figure 11A:
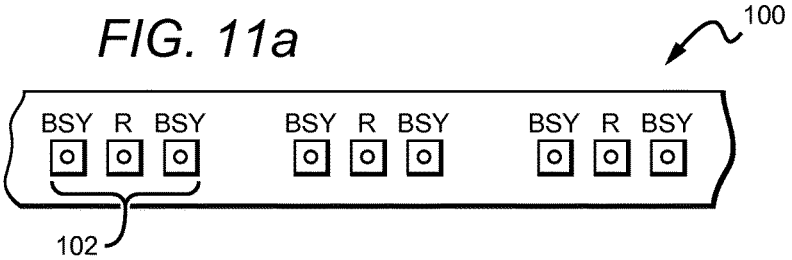
FIGS. 11*a-c* show lighting strips that may be used in embodiments of the present invention.
Figure 11B:
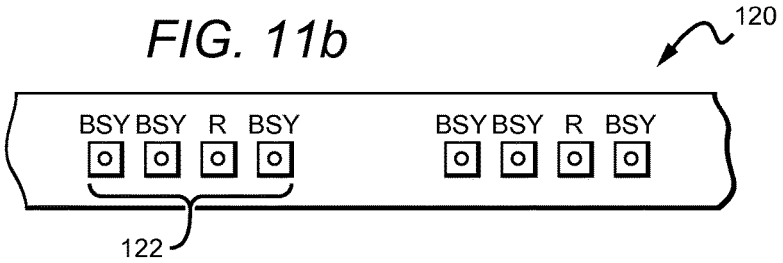
Figure 11C:
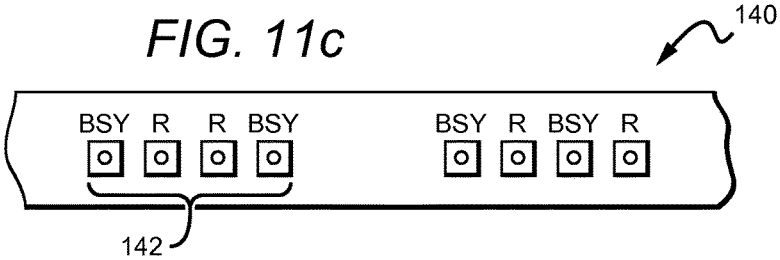

FIGS. 11*a-c* show lighting strips 100, 120, 140 each of which represent possible LED combinations that result in an output spectrum that can be mixed to generate white light. Each lighting strip can include the electronics and interconnections necessary to power the LEDs. In some embodiments the lighting strip comprises a PCB with the LEDs mounted and interconnected thereon. The lighting strip 100 includes clusters 102 of discrete LEDs, with each LED within the cluster 102 spaced a distance from the next LED, and each cluster 102 spaced a distance from the next cluster 102. If the LEDs within a cluster are spaced at too great distance from one another, the colors of the individual sources may become visible, causing unwanted color-striping. In some embodiments, an acceptable range of distances for separating consecutive LEDs within a cluster is not more than approximately 8 mm.

The scheme shown in FIG. 11*a* uses a series of clusters 102 having two blue-shifted-yellow LEDs ("BSY") and a single red LED ("R"). Once properly mixed the resultant output light will have a "warm white" appearance.

The lighting strip 120 includes clusters 122 of discrete LEDs. The scheme shown in FIG. 11*b* uses a series of clusters 122 having three BSY LEDs and a single red LED. This scheme will also yield a warm white output when sufficiently mixed.

The lighting strip 140 includes clusters 142 of discrete LEDs. The scheme shown in FIG. 11*c* uses a series of clusters 142 having two BSY LEDs and two red LEDs. This scheme will also yield a warm white output when sufficiently mixed.

The lighting schemes shown in FIGS. 11*a-c* are meant to be exemplary. Thus, it is understood that many different LED combinations can be used in concert with known conversion techniques to generate a desired output light color.

It is understood that embodiments presented herein are meant to be exemplary. Embodiments of the present invention can comprise any combination of compatible features shown in the various figures, and these embodiments should not be limited to those expressly illustrated and discussed. Many other versions of the configurations disclosed herein are possible. Thus, the spirit and scope of the invention should not be limited to the versions described above.

We claim:

1. A direct emission light fixture, comprising:

first and second end reflectors, wherein at least one of said end reflectors is configured to define an interior compartment, wherein said first and second end reflectors each comprise a central cutout portion;

at least one back reflector comprising at least two side reflectors between said first and second end reflectors, wherein said first and second end reflectors and said at least two side reflectors are each distinct components, wherein said at least two side reflectors are removably attached to said fixture;

a plurality of light sources on a light board, wherein at least a portion of said light board is between and aligned with said central cutout portion of said first and second end reflectors, wherein said light board extends to at least one of said central cutout portions; and a lens over said plurality of light sources.

2. The fixture of claim 1, wherein a first of said side reflectors is on a first side of said plurality of light sources and a second of said side reflectors is on a second opposite side of said plurality of light sources.

3. The fixture of claim 1, wherein said back reflector is faceted.

4. The fixture of claim 1, wherein said back reflector comprises a white reflective surface.

5. The fixture of claim 1, wherein said light board is removably attached to said fixture.

6. The fixture of claim 1, further comprising a driver circuit in said interior compartment.

7. The fixture of claim 1, further comprising a circuit isolation structure in said interior compartment.

8. The fixture of claim 1, further comprising a battery in said interior compartment.

9. The fixture of claim 1, wherein said plurality of light sources are distributed within a plurality of light emitter clusters, each cluster comprising discrete light emitters, such that each light emitter within a cluster is spaced a first distance from other light emitters within a cluster, and each cluster is spaced a second distance from other clusters.

10. The fixture of claim 1, wherein said plurality of light sources are evenly distributed.

11. A light fixture, comprising:

first and second end reflectors, wherein at least one of said end reflectors is configured to define an interior compartment, wherein at least one of said end reflectors comprises a removable access panel, wherein said first and second end reflectors each comprise a central cutout portion;

at least one back reflector comprising at least two side reflectors between said first and second end reflectors, wherein said first and second end reflectors and said at least two side reflectors are distinct from one another, wherein said at least two side reflectors are removably attached to said fixture;

a plurality of light sources on a light board, wherein said light board is between and aligned with said first and second end reflectors, wherein said plurality of light sources are oriented to output light in the same direction as said fixture, wherein said light board extends to at least one of said central cutout portions; and a lens over said plurality of light sources.

12. The fixture of claim 11, wherein a first of said side reflectors is on a first side of said plurality of light sources and a second of said side reflectors is on a second opposite side of said plurality of light sources.

13. The fixture of claim 11, wherein said light board is removably attached to said fixture.

14. The fixture of claim 13, wherein said back reflector is angled such that it is not parallel to said light board.

15. The fixture of claim 11, wherein said plurality of light sources are distributed within a plurality of light emitter clusters, each cluster comprising discrete light emitters, such that each light emitter within a cluster is spaced a first distance from other light emitters within a cluster, and each cluster is spaced a second distance from other clusters.

16. The fixture of claim 11, wherein said plurality of light sources are evenly distributed.

17. The fixture of claim 11, wherein light emitted from said plurality of light sources must pass through said lens to exit said fixture.

18. The fixture of claim 11, wherein at least a portion of said lens is more diffuse than the remainder of said lens.

19. The fixture of claim 11, further comprising a driver circuit in said interior compartment.

20. The fixture of claim 11, wherein said back reflector is configured to comprise a shape which is not planar.

* * * * *